US010504319B2

(12) United States Patent
Priddy

(10) Patent No.: US 10,504,319 B2
(45) Date of Patent: Dec. 10, 2019

(54) GAMING MACHINE INCLUDING DISPLAY TRANSITION SYSTEM

(71) Applicant: Video Gaming Technologies, Inc., Franklin, TN (US)

(72) Inventor: Ryan Priddy, Murfreesboro, TN (US)

(73) Assignee: Video Gaming Technologies, Inc., Franklin, TN (US)

( * ) Notice: Subject to any disclaimer, the term of this patent is extended or adjusted under 35 U.S.C. 154(b) by 322 days.

(21) Appl. No.: 15/393,832

(22) Filed: Dec. 29, 2016

(65) Prior Publication Data

US 2018/0190068 A1 Jul. 5, 2018

(51) Int. Cl.
*G07F 17/32* (2006.01)

(52) U.S. Cl.
CPC ..... *G07F 17/3216* (2013.01); *G07F 17/3202* (2013.01); *G07F 17/3211* (2013.01)

(58) Field of Classification Search
CPC ..... G07F 17/3202; G07F 17/3211; G07F 17/3216
See application file for complete search history.

(56) References Cited

U.S. PATENT DOCUMENTS 5,772,513 A * 6/1998 Ohishi ..... A63F 13/08 434/55
6,422,670 B1 * 7/2002 Hedrick ..... G07F 17/32 312/223.1
6,464,586 B1 * 10/2002 Kamata ..... G07F 17/32 463/25
6,880,825 B2 * 4/2005 Seelig ..... G07F 17/32 273/143 R
7,044,423 B2 * 5/2006 Bober ..... A47B 81/064 248/188.1
7,407,239 B2 * 8/2008 Kunz ..... B60P 3/34 312/312
7,562,872 B2 7/2009 Okada
7,806,490 B1 * 10/2010 Buehl ..... A47B 81/064 312/21
7,833,102 B2 * 11/2010 Beadell ..... G07F 17/32 463/46
8,096,884 B2 * 1/2012 Beadell ..... G07F 17/32 463/46
8,177,637 B2 * 5/2012 Beadell ..... A63F 13/08 463/16
8,388,444 B2 * 3/2013 Graf ..... G07F 17/3202 463/16
8,567,783 B2 10/2013 Cornell et al.
(Continued)

FOREIGN PATENT DOCUMENTS

CA 2577642 A1 8/2007

OTHER PUBLICATIONS

AU Patent Examination Report for AU Application No. 2017272174, dated Sep. 7, 2018. 6 pages.

*Primary Examiner* — William H McCulloch, Jr.
(74) *Attorney, Agent, or Firm* — Armstrong Teasdale LLP

(57) ABSTRACT

A gaming machine is provided, a cabinet having a longitudinal axis, a display coupled to the cabinet, and a display transition system. The display transition system is configured for selectively moving the display relative to the cabinet in a direction substantially parallel to the longitudinal axis and between a closed position in which game play at the gaming machine is enabled and an open position in which game play is disabled.

20 Claims, 5 Drawing Sheets

(56) References Cited

U.S. PATENT DOCUMENTS 8,951,117 B2 2/2015 Joko et al.
9,349,240 B2 5/2016 Castro et al.
9,687,747 B2 * 6/2017 Sprenger ..... A63F 13/90
9,697,679 B2 * 7/2017 Ho ..... G07F 17/3216
D820,915 S * 6/2018 Lee ..... D21/369
9,997,010 B2 * 6/2018 Lee ..... G07F 17/3211
10,002,488 B2 * 6/2018 Calhoun ..... G07F 17/3211
D833,534 S * 11/2018 Lee ..... D21/369
D834,652 S * 11/2018 Lee ..... D21/369
2002/0041133 A1 * 4/2002 Hedrick ..... G07F 17/32 312/223.1
2002/0044411 A1 * 4/2002 Iredale ..... G06F 1/1616 361/679.05
2002/0183106 A1 * 12/2002 Cole ..... G07F 17/32 463/16
2005/0032578 A1 * 2/2005 Cole ..... G07F 17/32 463/46
2006/0014586 A1 * 1/2006 Gatto ..... A47C 15/004 463/46
2006/0183544 A1 * 8/2006 Okada ..... G07F 17/32 463/31
2006/0287112 A1 * 12/2006 Mallory ..... G07F 17/32 463/46
2007/0089648 A1 * 4/2007 Harrison ..... A47B 9/16 108/115
2008/0004099 A1 1/2008 Ikeda
2008/0045294 A1 2/2008 Seelig et al.
2008/0113708 A1 * 5/2008 Beadell ..... A63F 13/08 463/16
2008/0113709 A1 * 5/2008 Beadell ..... G07F 17/32 463/16
2008/0113715 A1 * 5/2008 Beadell ..... G07F 17/32 463/17
2008/0113716 A1 * 5/2008 Beadell ..... G07F 17/32 463/17
2008/0113741 A1 * 5/2008 Beadell ..... G07F 17/32 463/20
2008/0113796 A1 * 5/2008 Beadell ..... G07F 17/32 463/35
2008/0113820 A1 * 5/2008 Tedsen ..... G07F 17/32 463/46
2008/0113821 A1 5/2008 Beadell et al.
2008/0265503 A1 * 10/2008 Wudtke ..... G07F 17/32 273/138.2
2009/0020665 A1 * 1/2009 Minke ..... A63F 13/02 248/176.1
2009/0036208 A1 2/2009 Pennington et al.
2009/0124395 A1 5/2009 O'Keene et al.
2009/0227380 A1 * 9/2009 Seelig ..... G07F 17/32 463/46
2010/0120530 A1 5/2010 Lesley et al.
2010/0210354 A1 * 8/2010 Burak ..... G07F 17/3202 463/25
2011/0136573 A1 * 6/2011 McComb ..... A63F 13/08 463/31
2012/0058830 A1 * 3/2012 Vollmann ..... G07F 17/3216 463/47
2015/0187166 A1 * 7/2015 Hennessy ..... G07F 17/3211 463/31
2016/0005262 A1 1/2016 Hirato et al.
2016/0093142 A1 * 3/2016 Lamb ..... G07F 17/3213 463/20
2016/0093143 A1 * 3/2016 Lamb ..... G07F 17/3213 463/20
2016/0256785 A1 9/2016 Sum
2016/0335836 A1 * 11/2016 Castro ..... G07F 17/3286
2016/0343204 A1 11/2016 Maher et al.
2017/0036107 A1 * 2/2017 Hennessy ..... G07F 17/3211
2018/0190068 A1 * 7/2018 Priddy ..... G07F 17/3216

* cited by examiner

GAMING MACHINE INCLUDING DISPLAY TRANSITION SYSTEM

BACKGROUND

The embodiments described herein relate generally to gaming machines and, more particularly, to a gaming machine that includes a transition system that enables at least a portion of a gaming machine display to selectively move vertically.

To increase the entertainment potential for and to attract players to gaming machines, at least some gaming machines are being formatted with increasing size and complexity. For example, at least some gaming machines use larger and/or curved displays, in order to increase a playable, interactive, and/or entertainment surface of the gaming machines. However, such gaming machines may be difficult to service, as the displays can be heavy and difficult or cumbersome to move to enable an interior of the gaming machine to be accessible. Moreover, at least some gaming machines may be unstable or top-heavy when the display is moved. Some gaming machines may alternatively be serviced by opening a side or back panel of the gaming machine, however, such an arrangement increases a footprint of the gaming machines and increases the inconvenience of maintenance thereof.

BRIEF DESCRIPTION

In one aspect, a gaming machine is provided. The gaming machine includes a cabinet having a longitudinal axis, a display coupled to the cabinet, and a display transition system for selectively moving the display relative to the cabinet in a direction substantially parallel to the longitudinal axis and between a closed position in which game play at the gaming machine is enabled and an open position in which game play is disabled.

In another aspect, a gaming machine is provided. The gaming machine includes a cabinet, a display coupled to the cabinet, and a display transition system for selectively elevating the display from a closed position in which game play at the gaming machine is enabled to an open position in which game play is disabled while maintaining the center of gravity of the gaming machine relative to a plane defined perpendicular to a direction of movement of the display.

In yet another aspect, a gaming machine is provided. The gaming machine includes a cabinet, a curved display coupled to the cabinet, and a display transition system a display transition system for selectively moving the curved display relative to the cabinet within a plane, between a closed position in which game play at the gaming machine is enabled and an open position in which game play is disabled.

In a further aspect, a gaming machine is provided. The gaming machine includes a cabinet having a longitudinal axis, a display coupled to the cabinet, the display having a longitudinal axis, and a display transition system for selectively moving the display relative to the cabinet between a closed position in which game play at the machine is enabled and the display longitudinal axis is a distance from the cabinet longitudinal axis, and an open position in which game play is disabled and the display longitudinal axis is the same distance from the cabinet longitudinal axis.

BRIEF DESCRIPTION OF THE DRAWINGS

The embodiments described herein may be better understood by referring to the following description in conjunction with the accompanying drawings.

Figure 1:
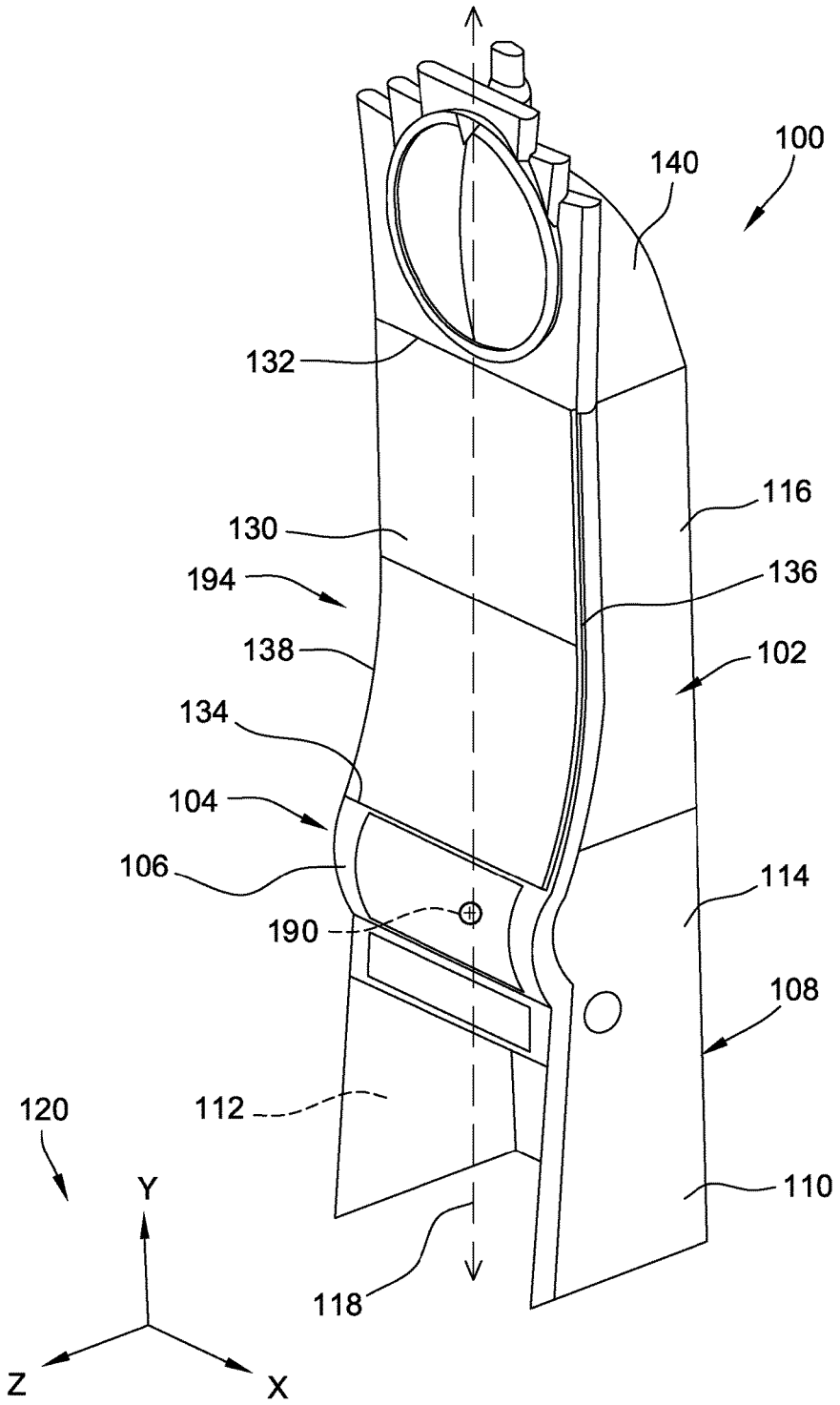
FIG. 1 is a front perspective view of an exemplary gaming machine in a closed configuration.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are intended to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to gaming machine embodiments providing player comfort and ergonomic considerations in industrial, commercial, and residential applications.

The following description refers to the accompanying drawings, in which, in the absence of a contrary representation, the same numbers in different drawings represent similar elements.

A gaming machine is described herein that includes a cabinet, a display, and a display transition system. The display is selectively moveable relative to a longitudinal axis of the cabinet using the display transition system. More specifically, the display transition system display enables the display to be selectively moved in a direction substantially parallel to the longitudinal axis of the cabinet and between a closed position in which game play of the gaming machine is enabled and an open position in which game play is disabled. Moreover, an open position may cause the gaming machine to enter a maintenance or service mode. In the exemplary embodiment, the display transition system is used to selectively move at least a display of the gaming machine. In other embodiments, the display transition system may, additionally or alternatively, selectively move a door (e.g., a cabinet door located on a front, rear, or side face of the cabinet) and/or any other component of the gaming machine which may or may not include a display device of the gaming machine. In the example embodiment, the display is a curved display. In other embodiments, the display may be a flat display, or a combination of curved and flat display screens. In some embodiments, a top box may be coupled to the display and may or may not be moved selectively within the display transition system.

In the exemplary embodiment, the longitudinal axis of the cabinet extends substantially vertically through the gaming machine as defined by a vertical axis (e.g., a Y-Axis in a 3-dimensional coordinate system). Accordingly, in the exemplary embodiment, the display transition system enables selective movement of the display between different positions relative to the vertical axis of the cabinet, while the display is maintained in its original orientation with respect to the cabinet. Thus, for example, a technician is able to view the display during maintenance in a substantially identical orientation as when the display is in its closed, operational position. Moreover, the display transition system enables the display to move such that a location of a center of gravity of the gaming machine within a plane perpendicular to the vertical direction (e.g., an X-Z plane) is substantially unchanged between the operational mode (i.e., the closed position) and the maintenance mode (i.e., an open position). Thus, a stability of the gaming machine in an open configuration is improved, and a risk of tipping of the gaming machine in the open configuration is reduced or eliminated. The design of a gaming machine including the display transition system disclosed herein also facilitates maintaining a substantially identical cabinet footprint between the closed, or operating, configuration and the open, or service, configuration. In other embodiments, the display transition system may be configured additionally or alternatively to selectively move the display along axes other than the vertical/longitudinal axis of the cabinet.

In the exemplary embodiment, the display transition system includes a guide rail that is coupled to the cabinet and that is used in cooperation with a slider coupled to the display. The guide rail may be a channel guide rail that enables the slider to selectively slide within the channel to selectively transition the display up and down. In the exemplary embodiment, the guide rail includes a C-channel guide rail, and the slider includes at least one of a wheel and a bearing. In other embodiments, the guide rail and/or the slider may include any other type of guide rail, channel, and/or slider configuration that enables the display transition system to function as described herein. In the exemplary embodiment, the display transition system includes a support cylinder that includes a cylinder base and a piston arm. The piston arm is slideable with respect to the cylinder base, and enables the support cylinder to maintain the display in an open position when engaged (i.e., when the piston arm is partially or fully extended outward from the cylinder base). For example, in one embodiment, the support cylinder may be a gas strut that assists in lifting and closing the gaming machine display, as described herein.

In other embodiments, the cabinet also includes a cabinet frame, and the display transition system also includes a display frame coupled to the display. In these embodiments, a guide rail is coupled to the cabinet frame and a slider is coupled to the display frame. As described above, the slider is slideable within the guide rail to selectively move the display frame relative to the cabinet frame. The display transition system includes a support cylinder including a cylinder base that is coupled to the cabinet frame and a piston arm is coupled to the display frame. The piston arm is slideable with respect to the cylinder base such that the support cylinder can selectively maintain the display frame in an open position with respect to the cabinet frame.

Figure 2:
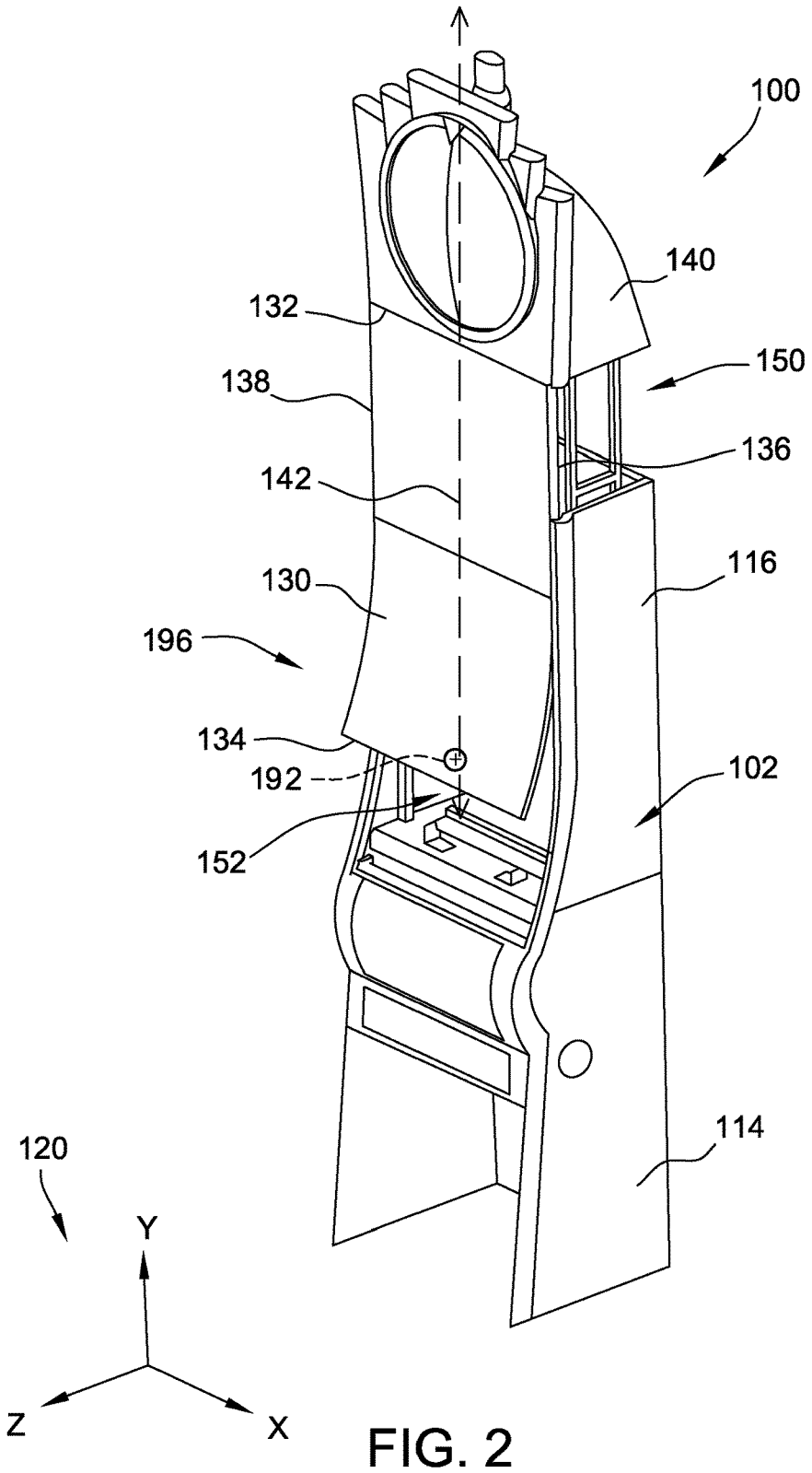
FIG. 2 is a front perspective view of the gaming machine shown in FIG. 1 in an open configuration.
Figure 3:
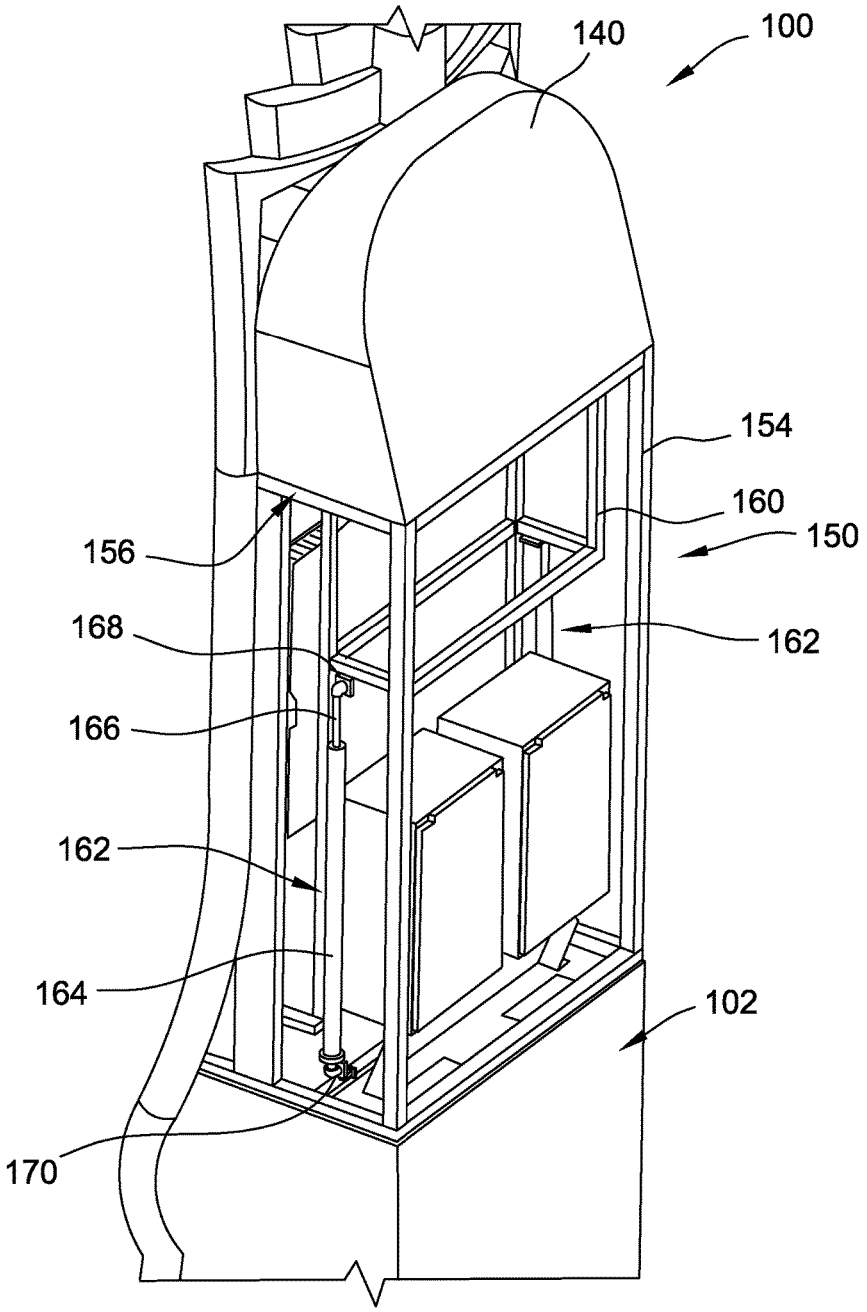
FIG. 3 is a rear cut-away view of the gaming machine shown in FIG. 1 in the closed configuration.
Figure 4:
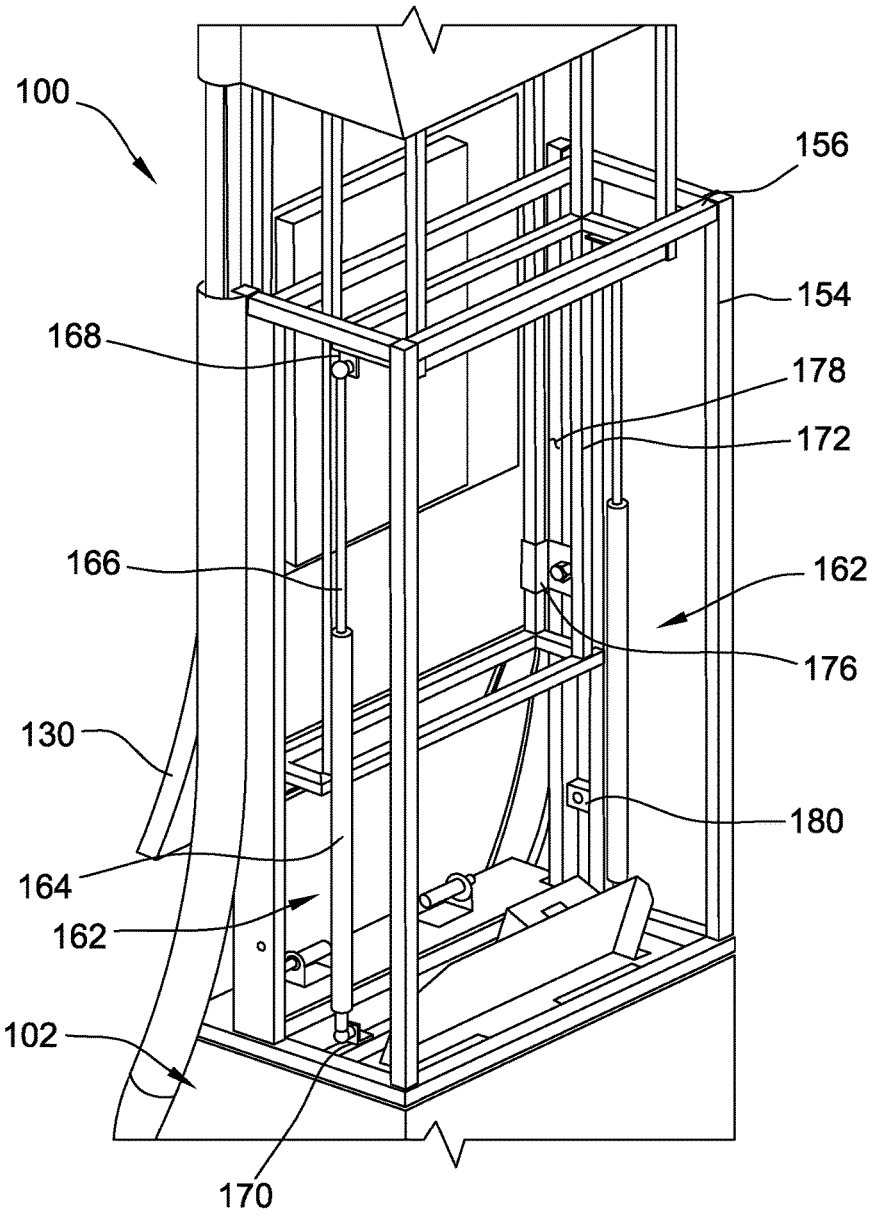
FIG. 4 is an enlarged, rear cut-away view of the gaming machine shown in FIG. 1 in the open configuration.
Figure 5:
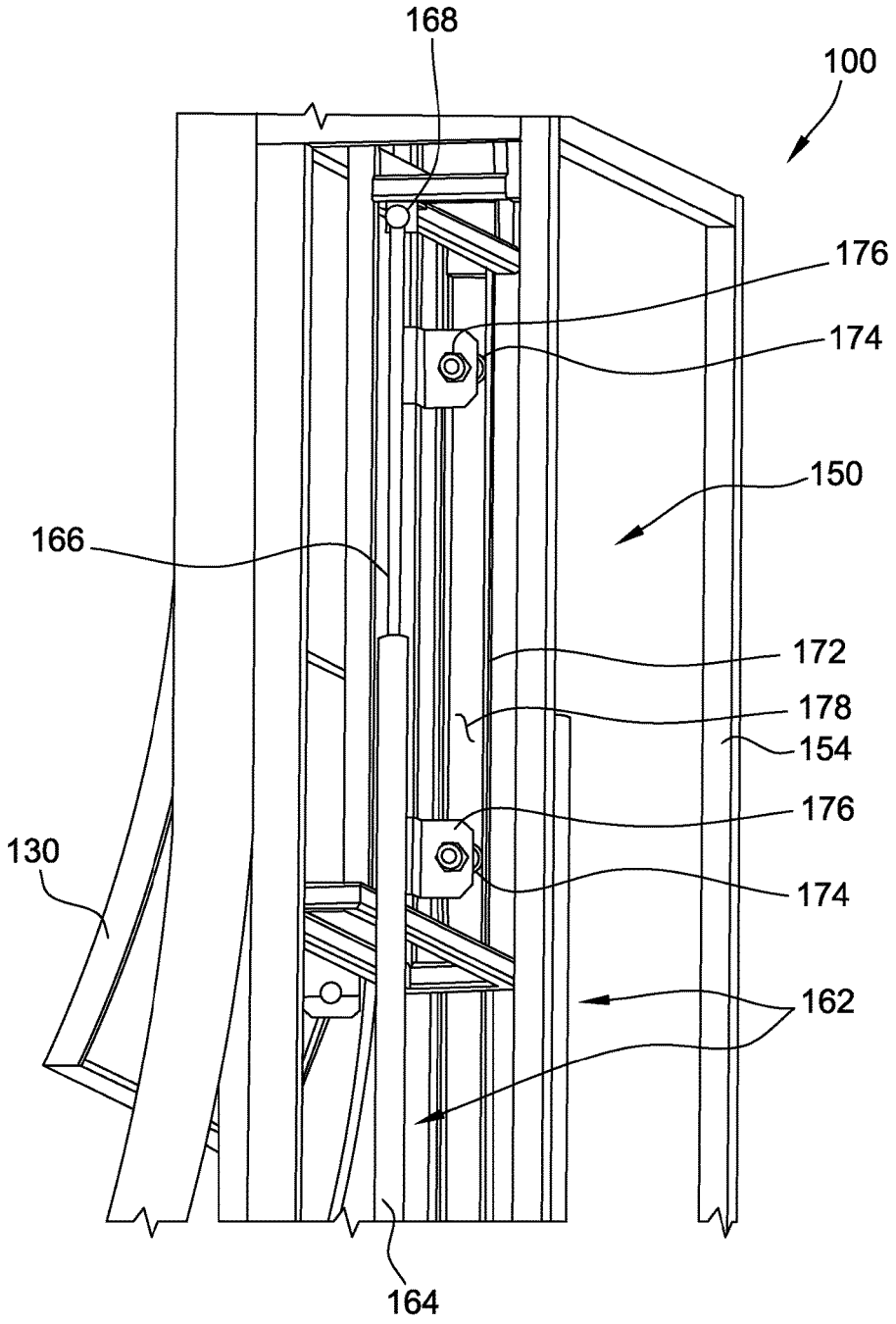
FIG. 5 is an enlarged, rear cutaway view of a portion of the gaming machine shown in FIG. 4.

Referring now to the figures, FIG. 1 is a front perspective view of an exemplary gaming machine 100 in a closed configuration. FIG. 2 is front a perspective view of gaming machine 100 in an open configuration. FIG. 3 shows a rear cut-away view of gaming machine 100 in the closed configuration, and FIG. 4 shows an expanded rear cut-away view of gaming machine 100 in the open configuration. FIG. 5 is an enlarged, rear cutaway view of a portion of gaming machine 100. In the exemplary embodiment, gaming machine 100 includes a cabinet 102 that houses a plurality of components, such as a gaming machine controller, peripheral devices, displays, and/or player interaction devices (e.g., switches, buttons). Cabinet 102 includes, broadly, a player interface 104. Player interface 104, in some embodiments, includes one or more touch screens used as player interfaces. Player interface 104 may additionally or alternatively include a credit input device, such as a coin acceptor for accepting coins and/or tokens, a bill acceptor for accepting and/or validating cash bills, coupons, and/or ticket vouchers, a card reader or a validator for use with credit cards, debit cards, identification cards, and/or smart cards, and/or a credit input module that interfaces with a server to accept credit and wagers.

In the exemplary embodiment, cabinet 102 includes a plurality of faces, specifically a front face 106, a rear face 108, and opposing side faces 110 and 112. Cabinet 102 also includes a lower portion or base 114 and an upper portion or body 116. In the exemplary embodiment, cabinet 102 has a longitudinal axis 118 that extends longitudinally through base 114 and body 116, and is substantially vertical. Accordingly, longitudinal axis 118 may also be referred to as a "vertical" axis 118. In the exemplary embodiment, longitudinal axis 118 may also be considered a centerline of cabinet 102 with respect to faces 110 and 112. With reference to a coordinate system 120 (illustrated in FIGS. 1 and 2), longitudinal axis 118 extends generally along a Y-Axis, and an X-Z plane is defined perpendicular to longitudinal axis 118. For example, cabinet base 114 may be positioned on a floor (not shown) oriented in the X-Z plane.

In the exemplary embodiment, gaming machine 100 also includes a display 130 that is coupled to cabinet 102. More specifically, in the exemplary embodiment, display 130 uses a single monolithic display screen. In other embodiments, display 130 may include a plurality of display screens adjacently tiled to give the appearance of being a single video display screen. In further embodiments, the plurality of display screens are tiled with a border or spacing that extends about at least a portion of one or more of the plurality of display screens. Additionally, display 130 may include a concavely curved transparent window including a plurality of flat panel video display screens arranged behind the window on an opposite, convex side of the window. The flat panel display screens may be adjacently tiled with respect to each other and/or may be overlapping with a portion of one flat panel display screen in front of, or behind, another of the flat panel display screens. Display 130 may also include, without limitation, a plasma display, a liquid crystal display (LCD), a TFT LCD (Thin-Film-Transistor Liquid Crystal Display), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user. Display 130 is mounted to cabinet 102 and is selectively moveable relative thereto, as described herein. In the exemplary embodiment, display 130 includes a curved or arcuate display. However, in one or more alternative embodiments, display 130 may include a flat or planar display, and/or a display having any other shape or profile.

In one embodiment, display 130 displays a game presentation that includes one or more game presentation objects, game images, symbols, or indicia, such as a visual representation or exhibition of movement of an object (e.g., a mechanical, virtual, or video reel), dynamic lighting, video images, and the like. Display 130 may include touch screen capabilities to facilitate player interaction with the game presentation. In addition, display 130 is bordered by a plurality of edges, specifically a top edge 132, a bottom edge 134, and opposing side edges 136 and 138. Display 130 has a vertical or longitudinal axis 142, or a vertical axis of symmetry 142 (shown in FIG. 2). Display longitudinal axis 142 is substantially parallel to cabinet longitudinal axis 118.

In the exemplary embodiment, gaming machine 100 includes a top box 140. Top box 140 may include artwork (not shown), such as, for example, artwork depicting one or more pay tables, bonus award information, an upper display, and/or other game information or imagery. At least a portion of top box 140 is coupled to display 130, such that the at least a portion of top box 140 moves with display 130, as described herein. In alternative embodiments, gaming machine 100 does not include top box 140. In other alternative embodiments, top box 140 is coupled to cabinet 102 such that top box 140 does not move with respect to cabinet 102.

Gaming machine 100 also includes a display transition system 150 for selectively moving display 130 between at least a closed position and an open position. In the exemplary embodiment, when display 130 is in a closed position, gaming machine 100 is in a closed configuration, as illustrated in FIGS. 1 and 3, and gaming machine 100 is operable for play of a game by a player, and/or game play is enabled. When display 130 is in an open position, gaming machine 100 is in an open configuration, as illustrated in FIGS. 2 and 4, such that gaming machine 100 is inoperable for play of the game, and/or game play is disabled. For example, when gaming machine 100 is placed in an open configuration, such a configuration may correspond to a maintenance or service mode of gaming machine 100, and an interior 152 of gaming machine 100 may be accessible. It should be understood that display 130 is selectively moveable between the closed position and a plurality of positions in which gaming machine 100 is open. Any such position may be an "open position," and accordingly, the "open position" need not be limited to a maximum or fully open position.

In the exemplary embodiment, cabinet 102 includes a cabinet frame 154 extending within body 116 of cabinet 102. Cabinet frame 154 at least partially defines front face 106, rear face 108, and opposing side faces 110 and 112 of cabinet 102. Cabinet frame 154 also defines a top 156 of cabinet body 116. Display transition system 150 includes a display frame 160 coupled to display 130. Display frame 160 is sized and oriented to move with respect to cabinet frame 154 as display 130 is moved between the closed and open positions.

In one embodiment, display 130 is in an open position when top box 140 is elevated a distance above cabinet body top 156, and/or when display bottom edge 134 is separated a distance from cabinet base 114. In other embodiments, display 130 is in an open position when display top edge 132 is raised a distance above cabinet body top 156. In some embodiments, display 130 is in the closed position when display bottom edge 134 is in contact with cabinet base 114, when display top edge 132 is aligned with cabinet body top 156, and/or when top box 140 is in contact with cabinet body top 156, in instances when top box 140 is selectively movable via display transition system 150. It should be understood that additional and/or alternative definitions of the open and/or closed positions of display 130 may be used. In the exemplary embodiment, display transition system 150 is used to selectively move display 130 between the closed and open positions and in a direction that is substantially parallel to longitudinal axis 118. More specifically, as display 130 is moved between the open and closed positions, display 130 is translated along the Y-axis, such that display 130 does not move along either the X- or Z-axes. In other words, display transition system 150 selectively moves display 130 only vertically between the closed and open positions. In addition, in the exemplary embodiment, display transition system 150 causes display 130 to move within an X-Y plane parallel to the Y-axis.

In the closed configuration, gaming machine 100 has a first center of gravity 190. In the exemplary embodiment, first center of gravity 190 is positioned along longitudinal axis 118. In alternative embodiments, first center of gravity 190 is positioned at any suitable location in the X-Z plane relative to longitudinal axis 118. In the open configuration, gaming machine 100 has a second center of gravity 192. Because transition system 150 causes display 130 to move parallel to the Y-axis, a location of second center of gravity 192 within the X-Z plane is substantially unchanged from the location of first center of gravity 190 within the X-Z plane. Thus, in some embodiments, display transition system 150 reduces movement of the center of gravity of gaming machine 100 relative to a footprint of gaming machine 100 when display 130 is opened, such that a risk of tipping of gaming machine 100 in the open configuration is limited.

In addition, display 130 in the closed position is oriented in a first orientation 194 with respect to cabinet 102. For example, in the exemplary embodiment, an upper portion of display 130 is parallel to longitudinal axis 118. In alternative embodiments, first orientation 194 is any suitable orientation of display 130 with respect to cabinet 102 that enables gaming machine 100 to function as described herein. Display 130 in the open position is oriented in a second orientation 196 with respect to cabinet 102. Because display transition system 150 causes display 130 to move parallel to the Y-axis, second orientation 196 is substantially identical to first orientation 194. Thus, for example, display transition system 150 enables a technician to view display 130 during maintenance or troubleshooting in a substantially identical orientation as when display 130 is in its closed, operational position. In addition, in the closed position, display longitudinal axis 142 is a first distance from cabinet longitudinal axis 118. In some embodiments, the first distance is "zero," such that display longitudinal axis 142 substantially corresponds to and/or overlaps cabinet longitudinal axis 118. In any open position, display longitudinal axis 142 is a second distance from cabinet longitudinal axis 118. Because display transition system 150 causes display 130 to move within the X-Y plane parallel to the Y-axis, the second distance is substantially identical to the first distance.

Similarly, a profile of gaming machine 100 projected onto the X-Z plane defines a footprint of gaming machine 100. Because display transition system 150 causes display 130 to move parallel to the Y-axis, the footprint of gaming machine 100 in the open configuration is substantially identical to the footprint of gaming machine 100 in the closed configuration. Thus, in some embodiments, a spacing of gaming machine 100 from other machines or fixtures need not be increased to enable maintenance of gaming machine 100.

In the exemplary embodiment, display transition system 150 includes one or more support cylinders 162 that assist in lifting and closing display 130. In one embodiment, display transition system 150 includes two support cylinders 162. However, it should be understood that less than or more than two support cylinders 162 may be used, depending on the size of display 130 and/or the operating specifications of support cylinders 162. Each support cylinder 162 includes a cylinder base 164 and a piston arm 166 that is slideable with respect to the corresponding cylinder base 164. In the exemplary embodiment, support cylinder 162 also includes a seal (not shown) that maintains a constant volume of gas within cylinder base 164. In the exemplary embodiment, piston arm 166 is coupled to display frame 160 (e.g., via a bracket 168), and cylinder base 164 is coupled to cabinet frame 152 (e.g., via a bracket 170). Support cylinders 162 include hydraulic support cylinders, such as gas struts, that assist in lifting display 130 and maintaining display 130 in the open position. More specifically, as display 130 is lifted to transition display 130 from the closed position to an open position, display frame 160 translates relative to cabinet frame 154, and accordingly, piston arm 166 slides relative to cylinder base 164 into an extended position (see FIG. 4). The pressure of gas in cylinder base 164 functions to maintain piston arm 166 in the extended position. Thereby, display 130 is maintained in the open position, until display 130 is selectively lowered to the closed position (or to a different open position).

Display transition system 150 also includes a guide rail 172. More particularly, guide rail 172 is integral to or is coupled to cabinet frame 152, and one or more sliders 174 are coupled to display frame 160 (e.g., via a respective bracket 176). In the exemplary embodiment, guide rail 172 is a C-channel guide rail that defines a channel 178 therein. Slider 174 is slideable within channel 178 as display frame 160 is translated relative to cabinet frame 154 to selectively transition display 130 between the closed and open positions. Slider 174 may include, for example, a guide wheel or a bearing. In the exemplary embodiment, guide rail 172 is oriented substantially parallel to cabinet longitudinal axis 118, thereby limiting the movement of display 130 between the closed and open positions and ensuring vertical translation of display frame 160 relative to cabinet frame 154 along the Y-axis.

Display transition system 150 may include one or more stops 180 positioned within guide rail channel 178. Stops 180 are configured to stop the travel of at least one slider 174 within channel 178. Accordingly, stops 180 may be positioned at locations within channel 178 that correspond to a lowermost position of a slider 174 (i.e., a lowermost position of display frame 160, where display 130 is in the closed position) and to an uppermost position of a slider 174 (i.e., an uppermost position of display frame 160, where display 130 is in a maximum open position).

The display transition system described herein enables movement of a gaming machine display between a closed position in which game play at the gaming machine is enabled and an open position in which game play is disabled. More specifically, the display transition system enables selective movement of the display only between different vertical positions, and only within a plane that is substantially parallel to a vertical or longitudinal axis of a gaming machine cabinet. Consequently, the center of gravity of the gaming machine, with respect to a plane perpendicular to the longitudinal axis, is maintained. The display transition system facilitates having a gaming machine with a smaller physical footprint, and may also facilitate improving stability of the gaming machine during the transition between a closed and an open configuration of the gaming machine. Accordingly, a risk of the gaming machine tipping while in the open configuration is substantially reduced or eliminated.

The systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems and/or methods as described herein.

Although the present disclosure is described in connection with an exemplary gaming system environment, embodiments of the present disclosure are operational with numerous other general purpose or special purpose gaming system environments or configurations. The gaming system environment is not intended to suggest any limitation as to the scope of use or functionality of any aspect of the disclosure. Moreover, the gaming system environment should not be interpreted as having any dependency or requirement relating to any one or combination of components illustrated in the exemplary operating environment.

When introducing elements of aspects of the present disclosure or embodiments thereof, the articles "a," "an," "the," and "said" are intended to mean that there are one or more of the elements. The terms "comprising," including," and "having" are intended to be inclusive and mean that there may be additional elements other than the listed elements.

The present disclosure uses examples to disclose the best mode, and also to enable any person skilled in the art to practice the claimed subject matter, including making and using any devices or systems and performing any incorporated methods. The patentable scope of the present disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming machine comprising:

a cabinet having a longitudinal axis;

a display coupled to the cabinet; and a display transition system comprising at least one support cylinder, the support cylinder comprising a cylinder base and a piston arm slideable with respect to the cylinder base, the display transition system configured to selectively move the display relative to the cabinet in a direction substantially parallel to the longitudinal axis and between a closed position in which game play at the gaming machine is enabled and an open position in which game play is disabled.

2. The gaming machine of claim 1, wherein the display transition system comprises a guide rail coupled to the cabinet and a slider coupled to the display, the slider slideable within the guide rail to move the display.

3. The gaming machine of claim 2, wherein the guide rail comprises a C-channel guide rail.

4. The gaming machine of claim 2, wherein the slider comprises at least one of a wheel and a bearing.

5. The gaming machine of claim 2, wherein the guide rail is oriented substantially parallel to the longitudinal axis.

6. The gaming machine of claim 1, wherein the support cylinder maintains the display in the open position.

7. The gaming machine of claim 1, wherein the piston arm is extended from the cylinder base when the display is in the open position.

8. The gaming machine of claim 1, wherein the cabinet comprises a cabinet frame, and the display transition system comprises a display frame coupled to the display.

9. The gaming machine of claim 8, wherein the display frame is moveable relative to the cabinet frame to move the display between the closed and open positions.

10. The gaming machine of claim 8, wherein the cylinder base is coupled to the cabinet frame and the piston arm is coupled to the display frame.

11. The gaming machine of claim 10, wherein the display frame is translated parallel to the longitudinal axis to move the display between the closed and open positions, and the piston arm is extended from the cylinder base when the display is in the open position.

12. The gaming machine of claim 8, wherein the support cylinder maintains the display in the open position.

13. The gaming machine of claim 8, wherein the cabinet frame comprises a guide rail and the display transition system further comprises a slider coupled to the display frame, the slider slideable with respect to the guide rail to move the display.

14. The gaming machine of claim 1 further comprising a top box coupled to the display.

15. The gaming machine of claim 1, wherein the display comprises a curved display.

16. The gaming machine of claim 1, wherein the gaming machine has a first center of gravity when the display is in the open position, the first center of gravity positioned in a first location relative to a plane defined perpendicular to the longitudinal axis, and a second center of gravity when the display is in the closed position, the second center of gravity positioned in a second location relative to the plane, wherein the first location is the same as the second location.

17. The gaming machine of claim 1, wherein the display has a first orientation relative to the cabinet in the closed position and a second orientation relative to the cabinet in the open position, wherein the first orientation is substantially identical to the second orientation.

18. A gaming machine comprising:

a cabinet;

a display coupled to the cabinet; and a display transition system comprising at least one support cylinder, the support cylinder comprising a cylinder base and a piston arm slideable with respect to the cylinder base, the display transition system configured to selectively elevate the display from a closed position in which game play at the gaming machine is enabled to an open position in which game play is disabled while maintaining the center of gravity of the gaming machine relative to a plane defined perpendicular to a direction of movement of the display.

19. A gaming machine comprising:

a cabinet;

a curved display coupled to the cabinet; and a display transition system comprising at least one support cylinder, the support cylinder comprising a cylinder base and a piston arm slideable with respect to the cylinder base, the display transition system configured to selectively move the curved display relative to the cabinet within a plane, between a closed position in which game play at the gaming machine is enabled and an open position in which game play is disabled.

20. A gaming machine comprising:

a cabinet having a longitudinal axis;

a display coupled to the cabinet, the display having a longitudinal axis; and a display transition system comprising at least one support cylinder, the support cylinder comprising a cylinder base and a piston arm slideable with respect to the cylinder base, the display transition system configured to selectively move the display relative to the cabinet between a closed position in which game play at the machine is enabled and the display longitudinal axis is a distance from the cabinet longitudinal axis, and an open position in which game play is disabled and the display longitudinal axis is the same distance from the cabinet longitudinal axis.

* * * * *